US010641022B2

(12) United States Patent
Stuart

(10) Patent No.: US 10,641,022 B2
(45) Date of Patent: May 5, 2020

(54) HINGE

(71) Applicant: Michael Christopher Stuart, Five Dock (AU)

(72) Inventor: Michael Christopher Stuart, Five Dock (AU)

( * ) Notice: Subject to any disclaimer, the term of this patent is extended or adjusted under 35 U.S.C. 154(b) by 0 days.

(21) Appl. No.: 15/670,713

(22) Filed: Aug. 7, 2017

(65) Prior Publication Data

US 2017/0335613 A1 Nov. 23, 2017

Related U.S. Application Data

(63) Continuation of application No. 14/784,240, filed as application No. PCT/AU2014/000432 on Apr. 15, 2014, now Pat. No. 9,759,000.

(30) Foreign Application Priority Data

Apr. 15, 2013 (AU) ..... 2013901292

(51) Int. Cl.
*E05D 11/10* (2006.01)
*E05D 5/06* (2006.01)
(Continued)

(52) U.S. Cl.
CPC ..... *E05D 11/1014* (2013.01); *E05D 3/02* (2013.01); *E05D 3/022* (2013.01); *E05D 5/06* (2013.01);
(Continued)

(58) Field of Classification Search
CPC .. E05D 3/02; E05D 3/022; E05D 5/06; E05D 5/14; E05D 7/1011; E05D 11/082;
(Continued)

(56) References Cited

U.S. PATENT DOCUMENTS 4,063,330 A 12/1977 Triplette
4,103,392 A 8/1978 MacDonald
(Continued)

FOREIGN PATENT DOCUMENTS

AU 666491 2/1996
AU 199959449 A1 8/2000
(Continued)

OTHER PUBLICATIONS

Extended European Search Report from counterpart European Application No. 14784866.7, dated Oct. 11, 2016, 6 pp.
(Continued)

*Primary Examiner* — Roberta S Delisle
(74) *Attorney, Agent, or Firm* — Shumaker & Sieffert, P.A.

(57) ABSTRACT

A hinge (100) including a first hinge leaf assembly, a second hinge leaf assembly pivotally coupled to the first hinge leaf assembly (101), a spring (138) operatively connected to the first and second hinge leaf assemblies, and a spring tensioning mechanism to adjust the bias of the spring (138). The first hinge leaf assembly includes a first hinge component (101) having a first mounting surface for securing to a first structure and a plurality of first knuckles (114, 115). The second hinge leaf assembly includes a second hinge component having a second mounting surface for securing to a second structure and a second knuckle (123). The spring biases the first hinge leaf assembly and the second hinge leaf assembly toward a closed position, wherein the spring is located with a hollow defined by coaxial alignment of the plurality of first knuckles (114, 115) and the second knuckle (123).

20 Claims, 18 Drawing Sheets

(51) Int. Cl.

| | |
|---|---|
| ***E05F 1/12*** | (2006.01) |
| ***E05F 5/02*** | (2006.01) |
| ***E05D 3/02*** | (2006.01) |
| ***E05F 1/10*** | (2006.01) |
| ***E05F 3/04*** | (2006.01) |
| ***E05D 5/14*** | (2006.01) |
| ***E05D 11/08*** | (2006.01) |
| ***E05F 5/10*** | (2006.01) |

(52) U.S. Cl.
CPC ..... *E05D 5/14* (2013.01); *E05D 11/082* (2013.01); *E05F 1/1008* (2013.01); *E05F 1/12* (2013.01); *E05F 1/1215* (2013.01); *E05F 3/04* (2013.01); *E05F 5/02* (2013.01); *E05F 5/10* (2013.01); *E05D 11/10* (2013.01); *E05D 2003/025* (2013.01); *E05D 2011/085* (2013.01); *E05Y 2201/46* (2013.01); *E05Y 2600/40* (2013.01)

(58) Field of Classification Search
CPC .... E05D 11/1014; E05D 11/10; E05F 1/1008; E05F 1/12; E05F 1/1215; E05F 3/04; E05F 3/20; E05F 5/02; E05F 5/10
USPC ..... 16/54, 255, 256, 257
See application file for complete search history.

(56) References Cited

U.S. PATENT DOCUMENTS

| | | | | |
|---|---|---|---|---|
| 4,155,144 | A | 5/1979 | Koganei | |
| 4,358,870 | A | 11/1982 | Hong | |
| 4,829,628 | A | 5/1989 | Vuksic | |
| 5,048,155 | A * | 9/1991 | Hwang | E05F 1/1215 16/301 |
| 5,463,795 | A * | 11/1995 | Carlson | E05D 5/14 16/273 |
| 5,570,917 | A | 11/1996 | Cutrer | |
| 5,572,768 | A | 11/1996 | Daul | |
| 5,715,574 | A * | 2/1998 | Schall | E05F 1/1215 16/301 |
| 6,408,484 | B1 | 6/2002 | Vandertouw | |
| 6,732,408 | B2 * | 5/2004 | Wu | E05D 11/00 16/273 |
| 6,928,699 | B2 | 8/2005 | Sawa | |
| 7,210,199 | B2 * | 5/2007 | Clark | E05D 5/06 16/299 |
| 7,966,693 | B2 | 6/2011 | Choi et al. | |
| 8,245,353 | B2 * | 8/2012 | Homner | E05F 1/1215 16/298 |
| 8,522,400 | B1 | 9/2013 | Jablonski | |
| 8,549,707 | B2 * | 10/2013 | Macernis | E05F 1/1215 16/298 |
| 8,661,618 | B2 | 3/2014 | Jablonski | |
| 9,121,207 | B2 | 9/2015 | Stuart | |
| 2007/0151077 | A1 | 7/2007 | Wei et al. | |
| 2007/0157432 | A1 | 7/2007 | Weinstein | |
| 2016/0060932 | A1 | 3/2016 | Stuart | |

FOREIGN PATENT DOCUMENTS

| | | | |
|---|---|---|---|
| CN | 2844358 | Y | 12/2006 |
| CN | 102112692 | A | 6/2011 |
| DE | 19949185 | A1 | 8/2000 |
| FR | 2763631 | A1 | 11/1998 |
| JP | 8193457 | A | 7/1996 |
| WO | 2009018615 | A1 | 2/2009 |
| WO | 2012103572 | A1 | 8/2012 |

OTHER PUBLICATIONS

International Search Report and Written Opinion for corresponding PCT Application No. PCT/AU2014/000432, dated Jul. 17, 2014, 13 pp.
Notice of the First Office Action from counterpart Chinese Application No. 201480030212.2, dated Oct. 28, 2016, 10 pp.
Reply to the Communication pursuant to Rules 70(2) and 70a(2) EPC dated Oct. 28, 2016, from counterpart European Application No. 14784866, filed on May 5, 2017, 14 pp.
International Preliminary Report on Patentability or corresponding PCT Application No. PCT/AU2014/000432, dated Oct. 20, 2015, 7 pp.
Prosecution History from U.S. Appl. No. 14/784,240, from Oct. 30, 2015 through May 8, 2017, 74 pp.
Examination Report dated Jul. 7, 2017 for corresponding Australian Application No. 2014253674, 3 pgs.
Examination Report dated Nov. 10, 2017 for corresponding New Zealand Application No. 713260, 7 pgs.
Examination Report dated Jul. 9, 2018 for corresponding New Zealand Application No. 713260, 4 pgs.

* cited by examiner

HINGE

CROSS-REFERENCE TO RELATED APPLICATIONS

The present application is a continuation of U.S. patent application Ser. No. 14/784,240 filed Oct. 13, 2015, which is a national stage entry under 35 U.S.C. § 371 of PCT Application No. PCT/AU2014/000432 filed on Apr. 15, 2014, which claims priority from Australian Provisional Patent Application No. 2013901292 filed on Apr. 15, 2013, the entire contents of each of which are incorporated herein by reference.

TECHNICAL FIELD

The present invention relates to a hinge.

BACKGROUND ART

A conventional hinge generally includes a pair of hinge components pivotally secured together. In particular applications, such as hinges for doors or gates, it is desirable to provide a hinge which biases the hinge components to either a closed or open position.

These type of hinges generally include a mechanical biasing element which is typically a spring in order to bias the movement of the hinge components to either the closed or open position. However, over time, parts of the hinge can wear and/or the spring looses torsional force, thereby leading to the hinge potentially failing to self close or self open.

Some hinges include a mechanism to adjust the tension in the spring so that the hinge may once again bias toward the open or closed position. However, such hinges generally require that portions of the hinge be taken apart to adjust the spring tension which is a time-consuming process. It would be beneficial if the spring tensioning process could be avoided as long as possible whilst still providing a hinge which biases toward to open or closed position fully even in the event that the spring looses tension.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

SUMMARY

In a first aspect there is provided a hinge including:

a first hinge component including: a first external surface for securing to a first structure; and a first magnetic element; and a second hinge component, pivotally coupled to the first hinge component, including: a second external surface for securing to a second structure; and a second magnetic element;

wherein magnetic force between the first and second magnetic elements bias the first and second hinge components toward a retained position.

In certain embodiments, the hinge includes a biasing mechanism configured to bias the first hinge component and the second hinge component toward the retained position.

In certain embodiments, the biasing mechanism is a spring.

In certain embodiments, a first end of the biasing mechanism is operably connected to the first hinge component and a second end of the biasing mechanism is operably connected to the second hinge component.

In certain embodiments, the first hinge component includes an upper and lower cylindrical section and the second hinge component includes an intermediate cylindrical section which is located between and coaxially with the upper and lower cylindrical sections.

In certain embodiments, the upper, lower and intermediate cylindrical sections include a hollow.

In certain embodiments, the hinge includes an upper cap member which couples with the upper cylindrical section and a portion of the upper cap member protrudes into the intermediate cylindrical section.

In certain embodiments, wherein the hinge includes a lower cap member that couples with the lower cylindrical section and a portion protrudes into the intermediate cylindrical section.

In certain embodiments, the hinge includes a adjustable braking arrangement configured to hinder movement between the first hinge component relative to the second hinge component during at least some portion of hinged motion toward the retained position.

In certain embodiments, the hinge includes a dampener configured to slow the movement of the first hinge component relative to the second hinge component when moving toward the retained position.

In certain embodiments, the dampening is a hydraulic dampener.

In certain embodiments, a body of the dampener is housed within a cavity of one of the first and second hinge components and wherein a pin of the dampening mechanism protrudes outwardly from the cavity and retracts within the body when the hinge moves toward the retained position.

In certain embodiments, the dampener is biased to eject a portion of the pin from the body once the first and second hinge components move from the retained position to an unretained position.

In certain embodiments, the first hinge component includes an L-shaped portion including a first and second arm which have respective faces which define the first external surface of the first hinge component.

In certain embodiments, the first arm includes a cavity for housing the first magnetic element.

In certain embodiments, the first magnetic element is retained within the cavity by a cover element.

In certain embodiments, the second hinge component includes an L-shaped portion including a first and second arm which have respective faces which define the second external surface of the second hinge component.

In certain embodiments, the first arm of the second hinge component includes a cavity for housing the second magnetic element.

In certain embodiments, the second magnetic element is retained within the cavity by a cover element.

In certain embodiments, the first and second hinge components includes apertures to enable a fixing means to secure the hinge to the first and second structures.

In another aspect there is provided a kit of parts for a hinge including:

a first hinge component including: a first external surface for securing to a first structure; and a first magnetic element; and a second hinge component, pivotally coupled to the first hinge component, including: a second external surface for securing to a second structure; and a second magnetic element;

wherein magnetic force between the first and second magnetic elements bias the first and second hinge components toward a retained position.

Other aspects and embodiments will be appreciated throughout the detailed description.

BRIEF DESCRIPTION OF FIGURES

The example embodiment of the present invention should become apparent from the following description, which is given by way of example only, of a preferred but non-limiting embodiment, described in connection with the accompanying figures.

MODES FOR CARRYING OUT THE INVENTION

Figure 2:
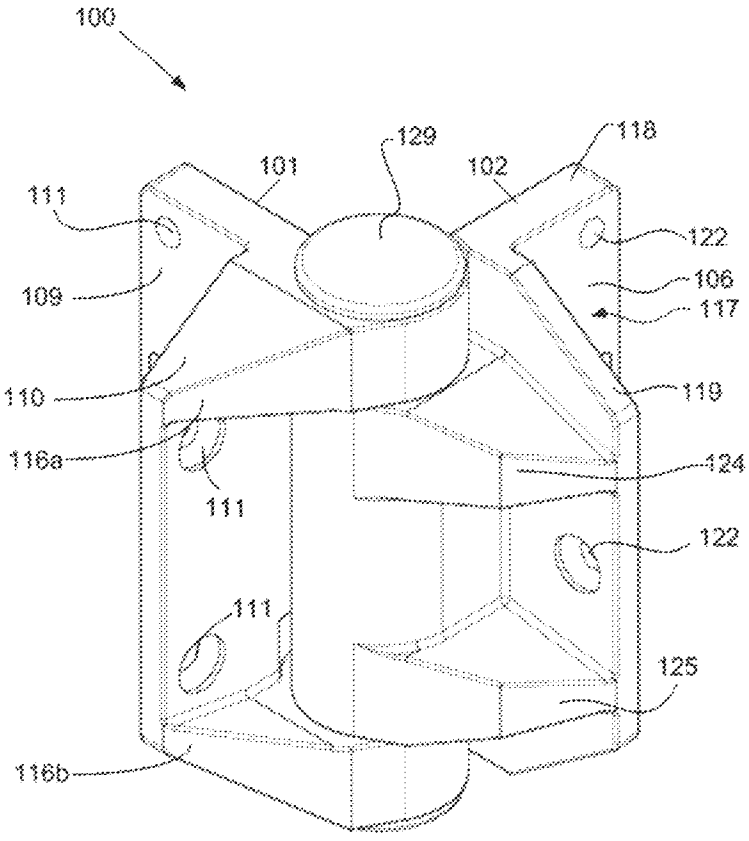
FIG. 2 illustrates an elevated front isometric view of the hinge of FIG. 1 in the open position.

The following modes, given by way of example only, are described in order to provide a more precise understanding of the subject matter of a preferred embodiment or embodiments.

In the figures, incorporated to illustrate features of an example embodiment, like reference numerals are used to identify like parts throughout the figures.

Referring to FIGS. 1 to 11, there is shown an example of a hinge 100. The hinge 100 includes a first hinge component 101 and a second hinge component 102 which are pivotally coupled together about a pivot axis 103 (see FIG. 11).

Figure 5:
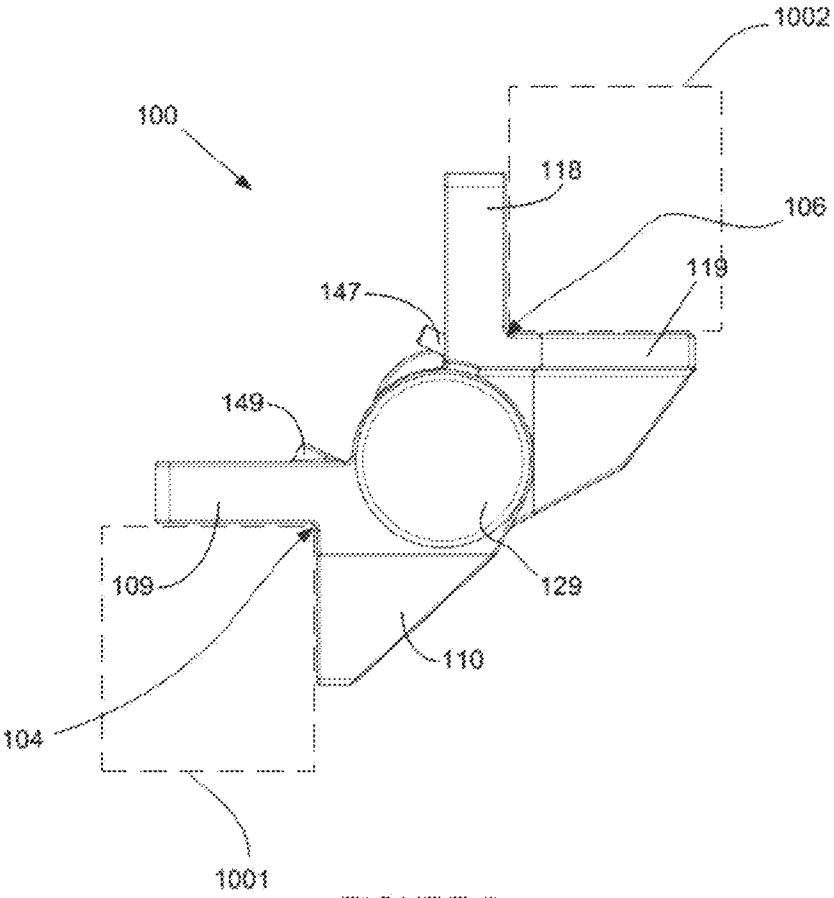
FIG. 5 is a top view of the hinge of FIG. 1 in the open position.
Figure 8:
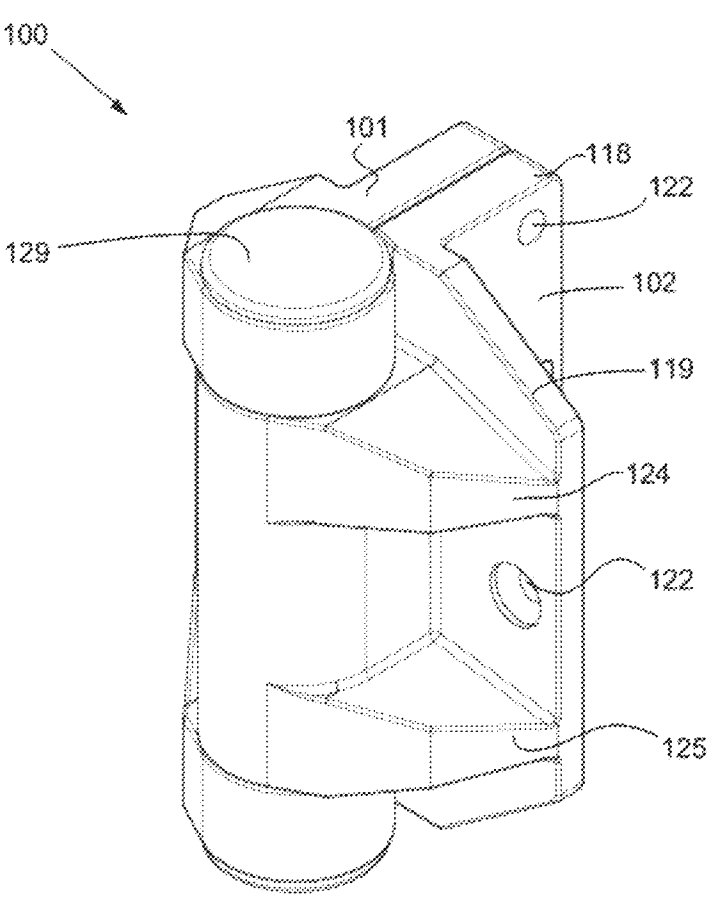
FIG. 8 is a second elevated front isometric view of the hinge of FIG. 1 in the closed position.
Figure 7:
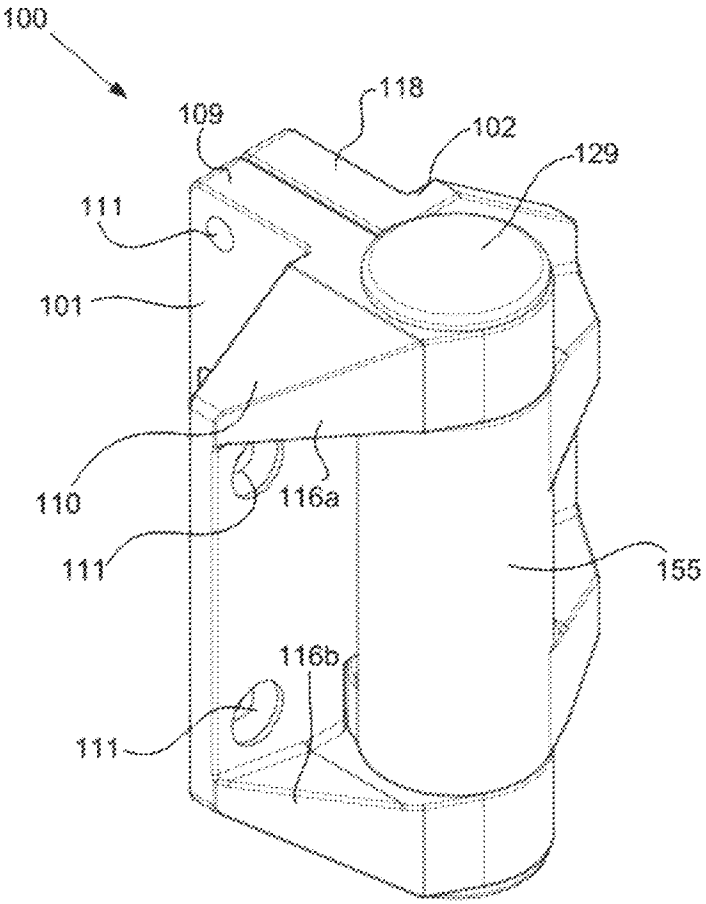
FIG. 7 is a first elevated front isometric view of the hinge of FIG. 1 in the closed position.
Figure 10:
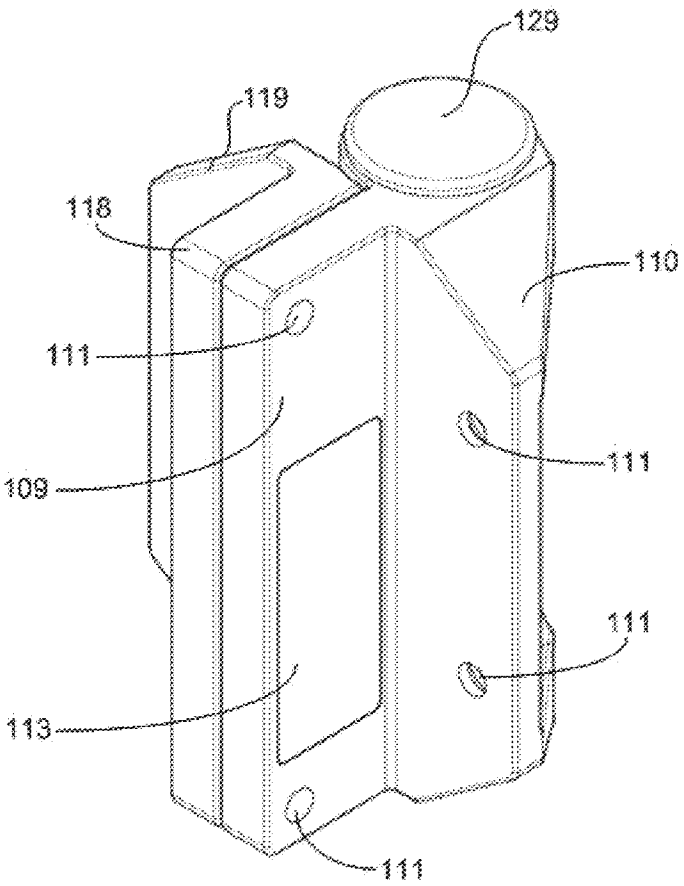
FIG. 10 is a second elevated rear isometric view of the hinge of FIG. 1 in the closed position.
Figure 9:
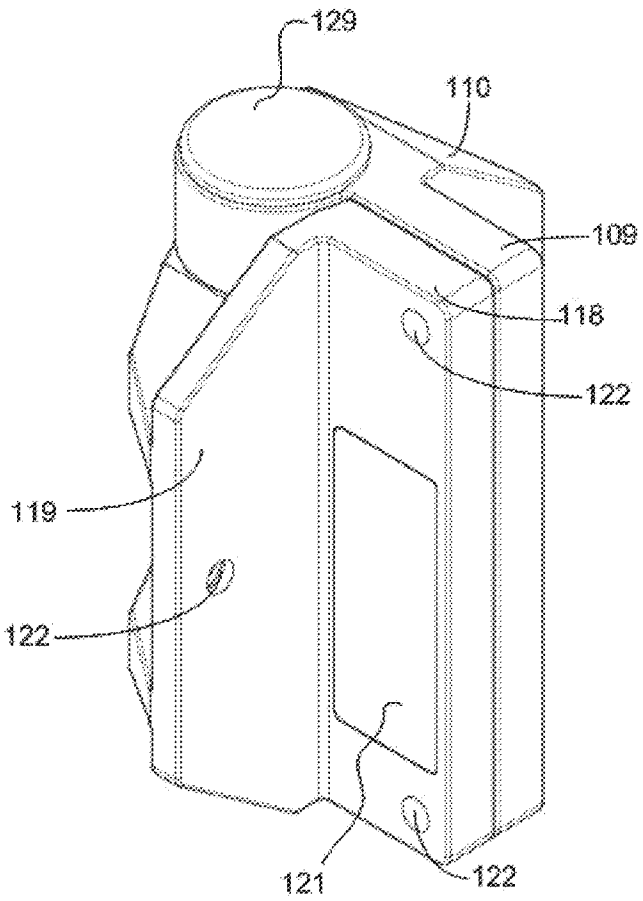
FIG. 9 is a first elevated rear isometric view of the hinge of FIG. 1 in the closed position.
Figure 11:
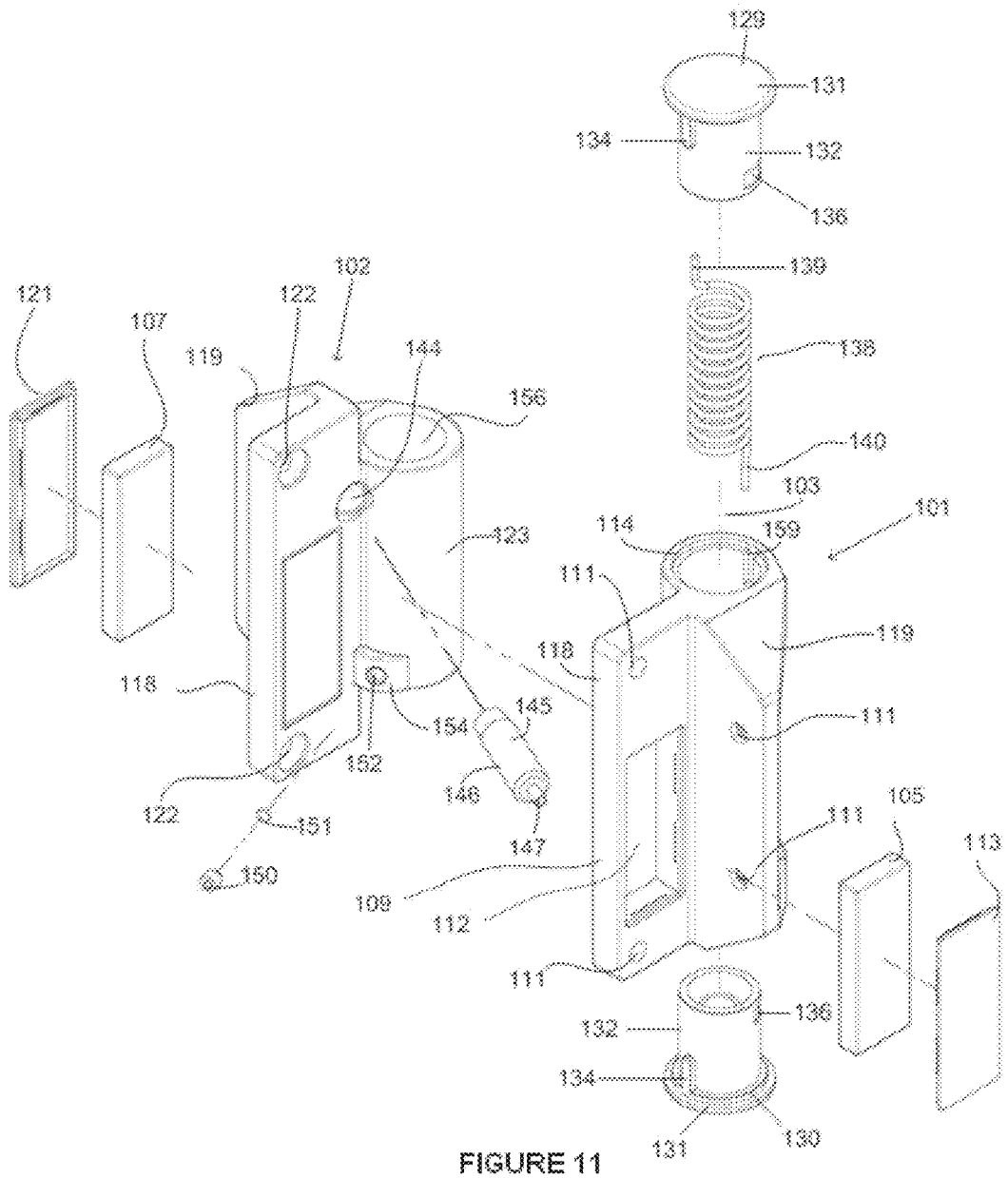
FIG. 11 is an exploded isometric view of the hinge of FIG. 1.
Figure 12:
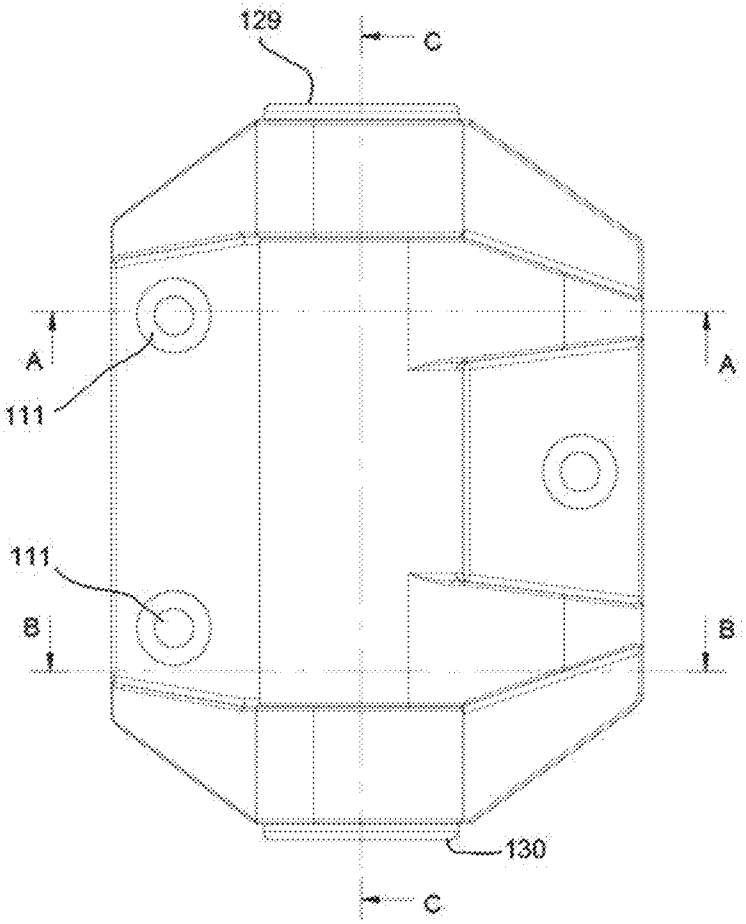
FIG. 12 is rear view of the hinge of FIG. 1 in the closed position.
Figure 14:
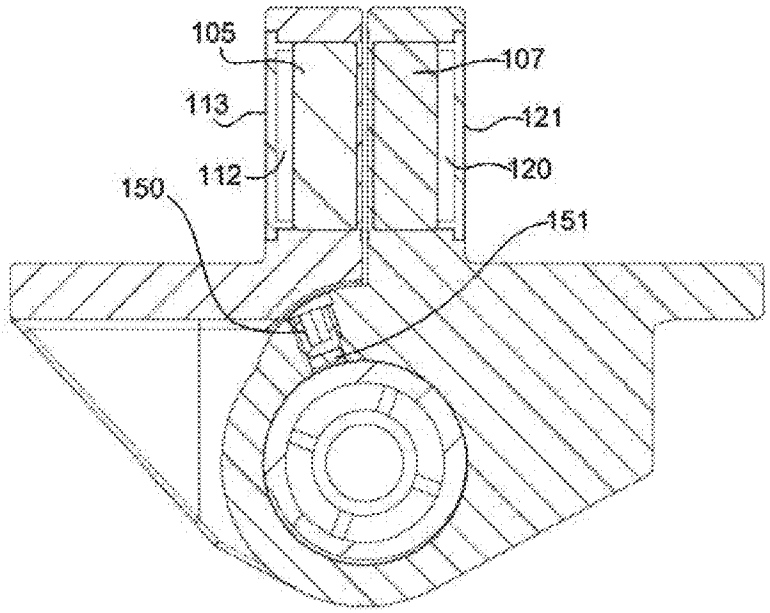
FIG. 14 is a cross-sectional view of the hinge along section B-B of FIG. 12.
Figure 16:
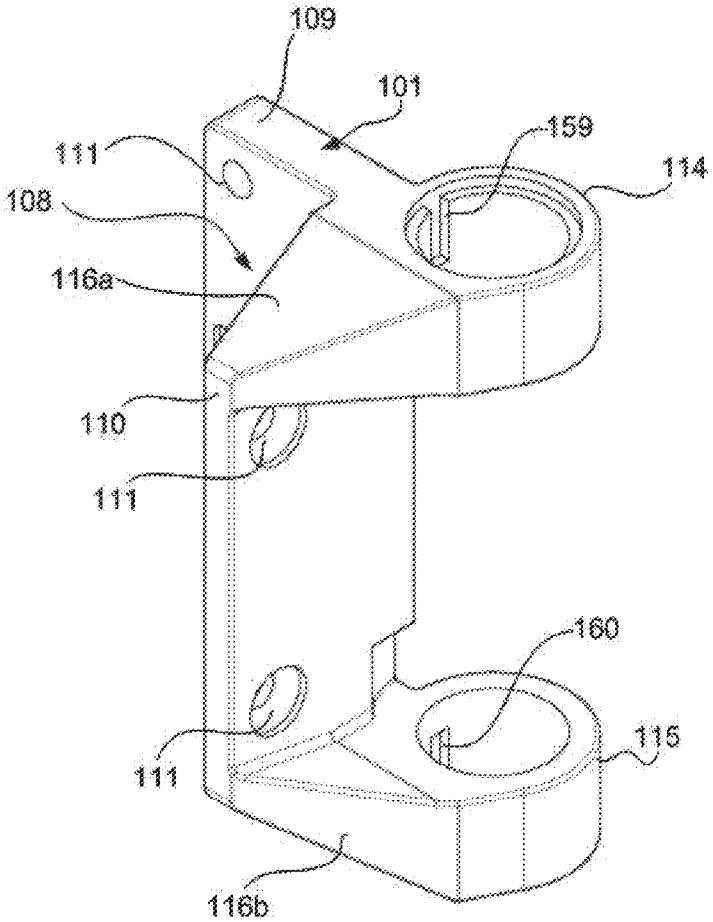
FIG. 16 is an isometric view of the first hinge component.

The first hinge component 101 includes a first external surface 104 for securing to a first structure 1001 (see FIG. 5, shown in broken line). In one particular form, the first structure 1001 is a portion of a gate such as a gate for a pool fence. As shown in FIGS. 11 and 14, the first hinge component 101 also includes a first magnetic element 105. FIG. 16 shows the first hinge component 101 isolated from the other components of the hinge 100.

The second hinge component 102 includes a second external surface 106 for securing to a second structure 1002 (see FIG. 5, shown in broken line). In one particular form, the second structure 1002 is a post. The second hinge component 102 also includes a second magnetic element 107 that is more clearly shown in the exploded view of FIG. 11 and cross-sectional view of FIG. 14.

The first and second magnetic elements 105, 107 are orientated such that preferably magnetic attraction between the first and second magnetic elements 105, 107 assist in biasing the first and second hinge components 101, 102 toward and maintaining the first and second hinge components 101, 102 in a retained position. As shown in FIG. 14, the magnetic elements 105, 107 are orientated such that the magnetic elements 105, 107 are attracted toward each other in a face-to-face arrangement. The retained position may be an open or closed position depending upon the configuration of the hinge 100 and its application (i.e. a hinge for a pool gate requires a closed retained position; a hinge for a toilet door requires an opened retained position). Throughout the remainder of the specification and for the purposes of clarity, the hinge 100 will be described in relation to a closed retained position.

As the magnetic elements 105, 107 do not suffer from wear, the magnetic elements 105, 107 supplement disadvantages of mechanical biasing elements such as springs and the like which generally fail over time, at least in some degree. Thus, as a mechanical biasing element of a hinge wears, the magnetic elements 105, 107 assist with biasing the hinge to the retained position. This therefore delays the time when the spring needs to be tensioned.

Figure 1:
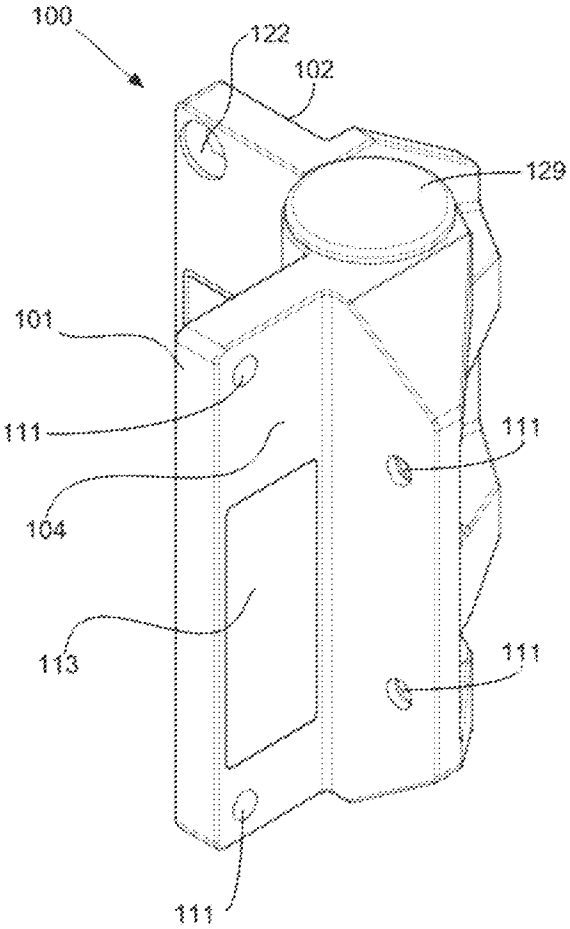
FIG. 1 illustrates an elevated side isometric view of an example of the hinge in the open position.
Figure 4:
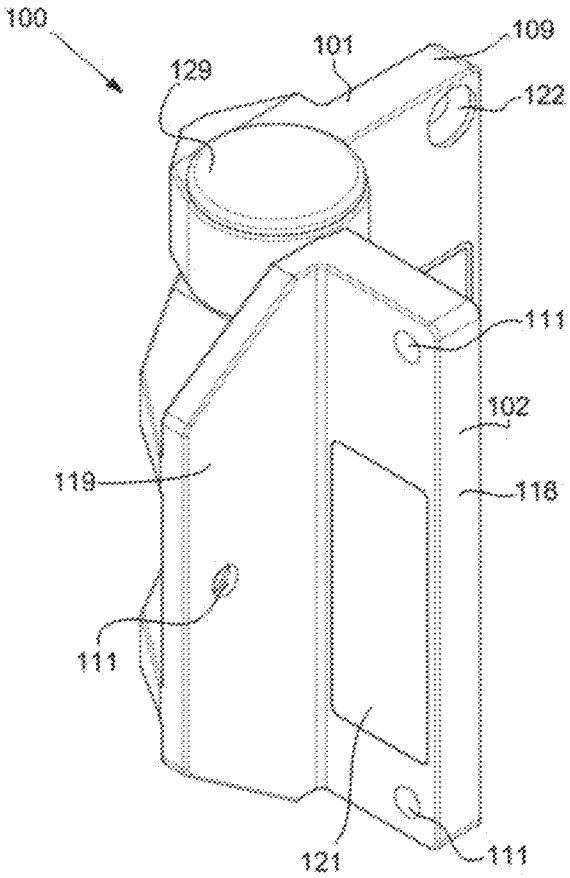
FIG. 4 is an elevated opposing side isometric view of the hinge of FIG. 1 in the open position.

Referring to FIGS. 1 and 16, the first hinge component 101 includes a first securing portion 108 which provides the first external surface 104 for resting against and securing the first hinge component 101 to a structure such as a post or door. The first securing portion 108 has a profile that corresponds to a portion of the structure that the first hinge component 101 is secured thereto. In the example depicted in the figures, the first securing portion 108 of the first hinge component 101 has an L-shaped profile including substantially orthogonal arms 109, 110 for securing the first hinge component 101 to different orthogonal faces of a structure such as a square/rectangular post. The first securing portion 108 of the first hinge component 101 includes a plurality of apertures 111 to enable a fixing means, such as screws or the like, to secure the first hinge component 101 to the structure.

Figure 18:
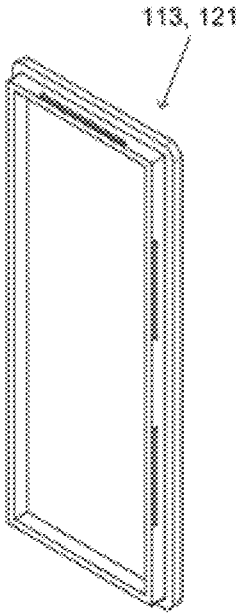
FIG. 18 is an isometric view of the cover element.
Figure 22:
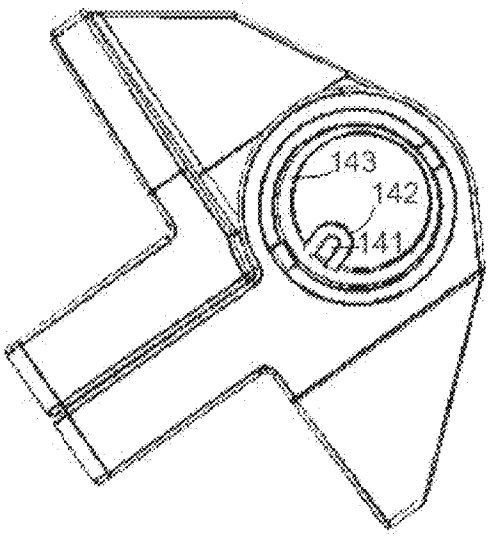
FIG. 22 is a top view of the hinge with the spring and cap members removed.

A first arm 109 of the first securing portion 108 of the first hinge component 101 is provided as a substantially flat plate and the second arm 110 is a ridged plate. The first arm 109 includes a recess 112 provided in the form of a cavity that has located therein the first magnetic element 105 of the hinge 100 as shown in FIGS. 11 and 14. The first magnetic element 105 is retained in the recess 112 (see FIG. 11) and covered with a cover element 113 (see FIGS. 14 and 18) to form the flat profile of the first arm 109. The external surface of the cover element 113 sits substantially flush with the face of the first arm 109 such that the first external surface can sit flush against the structure 1001.

The first hinge component 101 includes two short cylinder sections 114, 115 spaced apart from one another including an upper cylinder section 114 and a lower cylinder section 115, located at the outside of the corner of the L shaped member 108, such that the central axes of the cylinder sections 114, 115 align. The upper and lower cylinder sections 114, 115 are provided in the form of upper and lower ring sections. The cylinder sections 114, 115 are formed such that they merge with ridges 116*a*, 116*b* that run along the second arm 110 and taper to a point at the far edge of the second arm 110.

Figure 3:
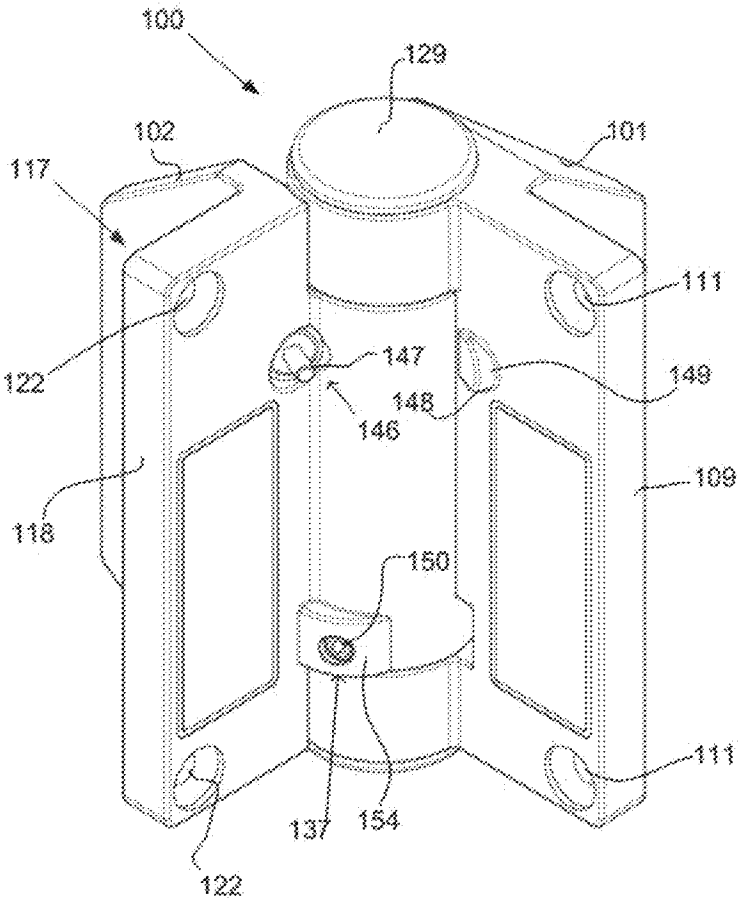
FIG. 3 is an elevated rear isometric view of the hinge of FIG. 1 in the open position.
Figure 6:
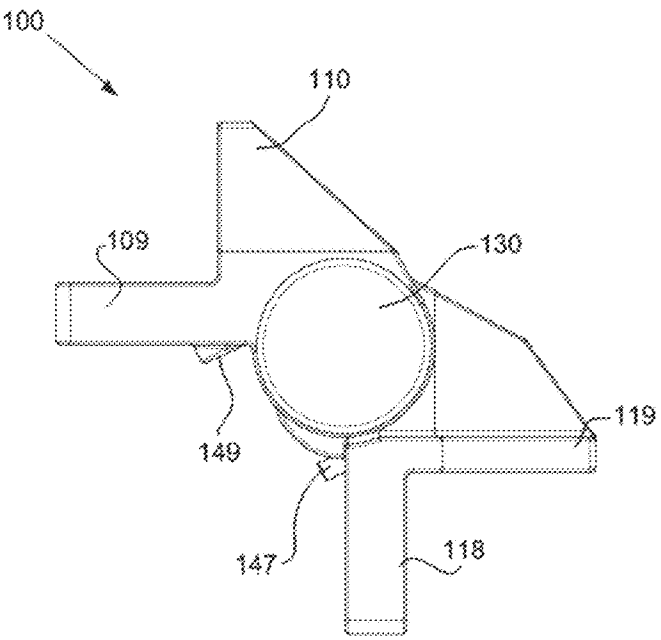
FIG. 6 is a bottom view of the hinge of FIG. 1 in the open position
Figure 17:
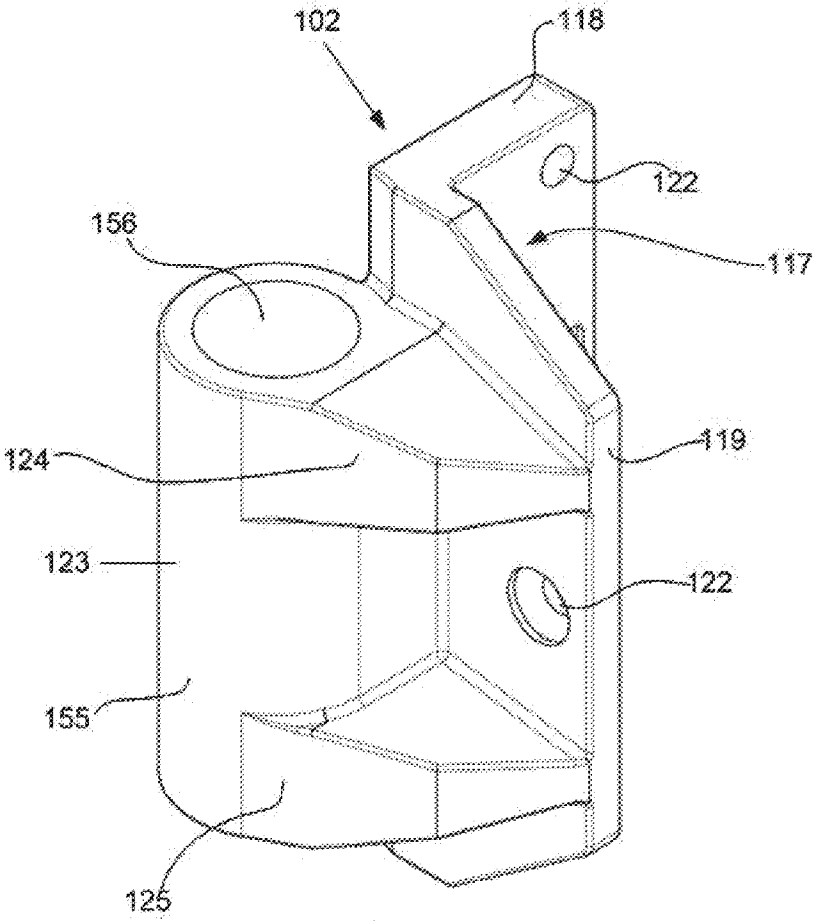
FIG. 17 is an isometric view of the second hinge component.

Referring to FIGS. 2, 3 and 17 there is shown the second hinge component 102 which includes a second securing portion 117 providing the second external surface 106 for securing the second hinge component 101 to the second structure 1002. The second securing portion 117 has an L-shaped profile with a first arm 118 provided in the form of a flat plate and a second arm 119 provided in the form of a ridged plate. As shown in the cross-sectional view of FIG. 14, the first arm 118 includes a recess 120 in the form of a cavity that has located therein the second magnetic element 107 of the hinge 100. The second magnetic element 107 is retained in the cavity 120 and covered with a cover element 121 (see FIGS. 14 and 18) to form the flat profile of the first arm 118. The external surface of the cover element 121 sits substantially flush with the face of the first arm 118 such that the second external surface 106 can sit flush against the structure 1002.

Similarly to the first hinged component 101, the L-shape of the second securing portion 117 allows for the second hinge component 102 to attach to two faces of a rectangular/square structure such as a post, door or other mounting point as shown in FIG. 5. The second securing portion 117 also includes apertures 122 to enable it to be secured using a fixing means.

The second hinge component 102 includes an intermediate cylinder section 123, extending from the outside of the corner of the L shaped second securing portion 117. The intermediate cylinder section 123 has an axial length which substantially corresponds to the spacing between the upper and lower cylinder sections 114, 115 of the first hinge component 101. As shown in FIGS. 1 and 2, the intermediate cylinder section 123 is located between the upper and lower cylindrical sections 114, 115 such that the cylinder sections 114, 115, 123 are coaxial.

As shown in FIG. 17, the ridges 124, 125 which extend along the back of the second arm 119 of the L-shaped second securing portion 117 extend toward and merge with the intermediate cylinder section 123. The intermediate cylinder 123 and ridges 124, 125 form a C shape on the outside of the second arm 119.

As shown in FIGS. 16 and 17, the cylinder sections 114, 115, 123 are hollow thereby defining a common void 126 when placed in a co-axial arrangement that extends through the cylinder sections 114, 115, 123. The co-axial cylinder sections 114, 115, 123 include a top open end and a bottom open end. Referring to FIG. 11, the first and second hinge components 101, 102 are pivotally coupled together via cap members 129, 130 which protrude through the top and bottom open ends of the co-axial cylinder sections 114, 115, 123.

Figure 21:
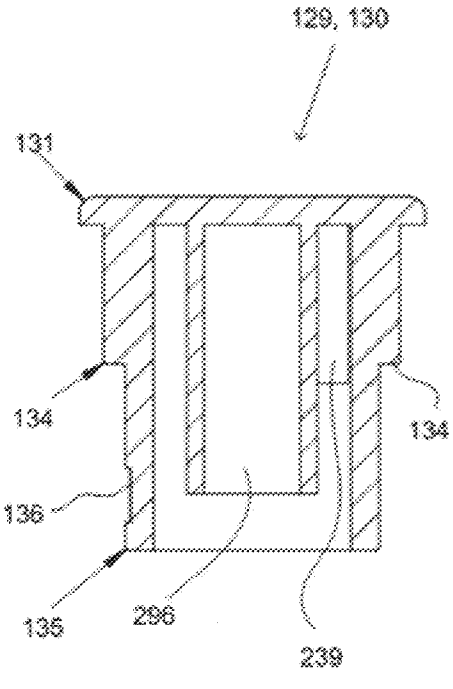
FIG. 21 is a cross-sectional view of the cap member along section D-D.
Figure 20:
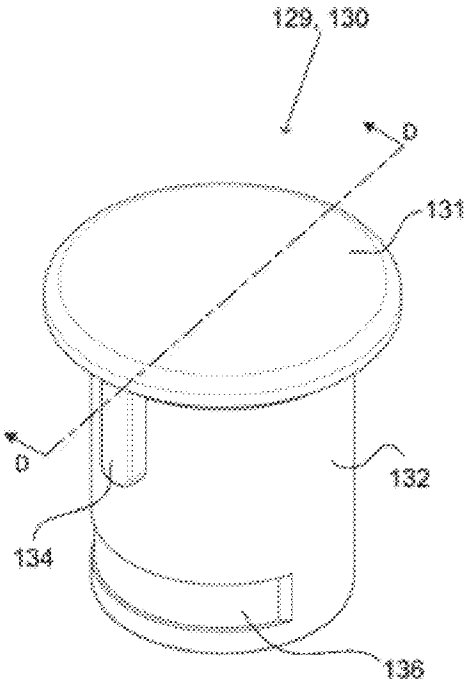
FIG. 20 is an elevated view of a cap member.

In particular, referring to FIGS. 20 and 21 there is shown an example of a lower cap member 130. The lower cap member 130 may also be used as the upper cap member 129. The lower cap member 130 has a head 131 and a neck 132. The external wall of the neck 132 includes one or more keyed portions 134 (in the example, diametrically opposing keyed sections) for engaging with one or more corresponding recesses 159, 160 (see FIG. 16) in the inner walls of the upper and lower cylindrical sections 114, 115 of the first hinge component 101. The neck 132 of the upper cap member 129 extends through the upper cylinder section 114, wherein a distal portion 135 of the neck 132 relative to the head 131 protrudes downwardly into an upper portion of the intermediate cylindrical section 123. Similarly, the neck 132 of the lower cap member 130 extends through the lower cylindrical section 115, wherein a distal end 135 of the neck 132 relative to the head 131 protrudes upwardly into a lower portion of the intermediate cylindrical section 123. Whilst the distal ends 135 of the necks 132 of the cap members 129, 130 extend into the intermediate cylindrical section 123 thereby coupling the first hinge component 101 to the second hinge component 102 by forming a hinge pin, the distal ends 135 are able to freely rotate within the intermediate cylindrical section 123 thereby enabling the pivotal movement between the first and second hinge components 101, 102. As will be discussed in more detail below, the lower cap member 130 includes a recessed section 136 adjacent the distal portion 135 of the neck 132. For convenience in manufacturing, both end caps 129, 130 can include the recessed section 136. However, it is possible that only the lower end cap 130 requires the recessed section 136 in order to provide a braking mechanism 137 for the hinge 100.

Figure 15:
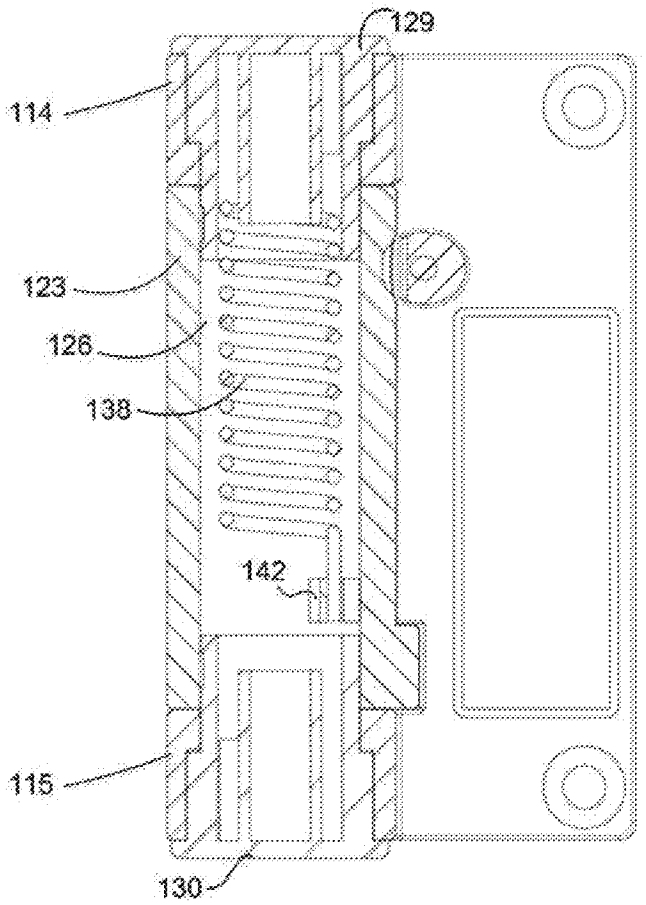
FIG. 15 is a cross-sectional view of the hinge along section C-C of FIG. 12.

As shown in FIG. 15, the hinge 100 includes a biasing mechanism 138 in the form of a torsional spring which is located within the hollow of the intermediate cylindrical section 123. A top spring tail 139 of the spring 138 engages the upper cap member 129, such that the spring 138 is operably connected to the first hinge component 101. In certain embodiments, the top spring tail 139 urges against an inner wall 239 located within the top cap member 129 as shown in FIG. 21. A bottom spring tail 140 of the spring 138 is located within a hole 141 of a protrusion 142 extending from the inner wall 143 of the intermediate cylindrical section 123, such that the spring 138 is also operably connected to the second hinge component 102. Due to this operable connection of the spring 138 to the first and second hinge components 101, 102, movement of the hinge 100 from the retained position causes potential energy to build in the spring 138 thereby urging the first and second hinge components 101, 102 toward the retained position again.

Figure 13:
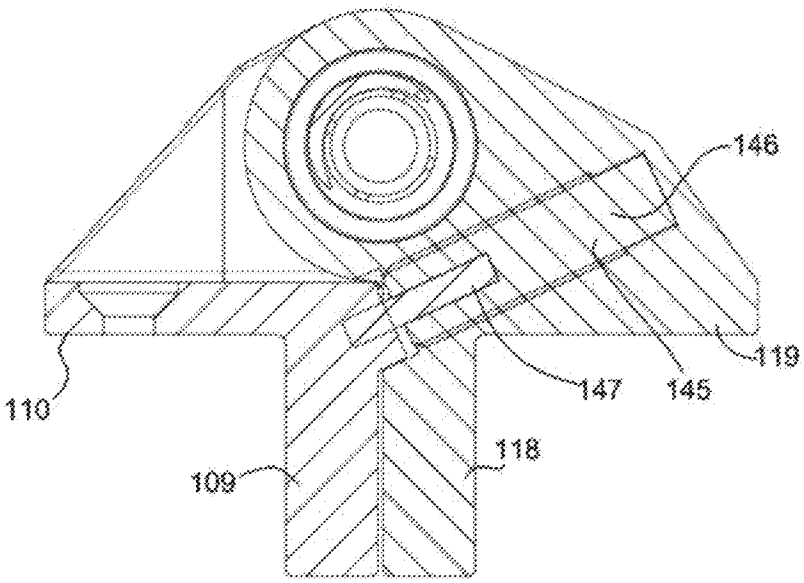
FIG. 13 is a cross-section view of the hinge along section A-A of FIG. 12.
Figure 19:
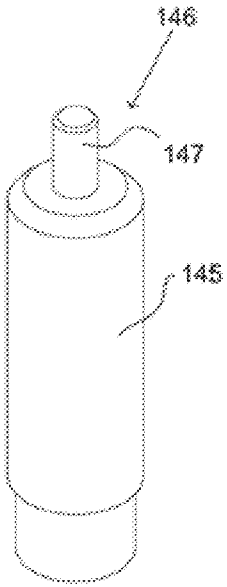
FIG. 19 is an elevated front view of a dampener.

As shown in FIG. 11, the second hinge component 102 includes a void 144 having an opening in the first arm 118 of the second securing portion 117. As shown in FIG. 3, the void 144 receives therein a body 145 of a dampener 146 (see FIG. 19). The void 144 can include an internal thread that engages with a threaded section of the body 145 of the dampener 146 to secure the dampener 146 within the void 144. The dampener 146 is preferably a hydraulic dampener including a pin 147 that extends from the body 145. As shown in FIGS. 3 and 5, the pin 147 extends outwardly from the face of the first arm 118 when the hinge 100 is located in an open position. As can be seen from FIG. 13, the void 144 extends into the upper ridge 124 of the second hinge component 102. As shown in FIG. 3, the first arm of the 109 of the first hinge component 101 includes a void 148 for housing a striker plate 149 which contacts the pin 147 when the hinge 100 moves to the retained position. The outer face of the striker plate 149 is angled inwardly toward the axis 103 of the hinge 100.

As the hinge 100 moves toward the retained position such that the magnetic elements 105, 107 provide a magnetic force aiding this hinged movement, the pin 147 of the dampener 146 will come into contact with the striker plate 149 of the first component 101, wherein the pin 147 slowly retracts within the body 145, thereby slowing the approach of the first arms 109, 118 toward one another. In the closed position, at least a portion of the striker plate 149 protrudes within the void 144 housing the dampener 146 in order to allow the hinge 100 to fully close.

FIGS. 1 to 10 show the hinge 100 in a range of positions. This is made possible because the ridges 124, 125 on the second hinge component 102 are spaced sufficiently to fit between the ridges 116*a*, 116*b* of the first hinge component 101 when in the fully open position.

FIGS. 7 to 10 show the hinge 100 in the closed position. In this position the first arms 109, 118 of the first and second hinge component 101, 102 are located in a side-by-side relationship, which also locates the first and second magnetic elements 105, 107 in close magnetic proximity of one another. FIGS. 1 to 6 show the hinge 100 in an open position. In this position the two L shaped securing portions 108, 117 form an X shape when viewed along the pivot axis 103. As shown in FIG. 3, the pin 147 of the dampener 146 protrudes from the first arm 118 of the second hinge component 102.

The hinge 100 can also include a braking mechanism 137. In particular, the braking mechanism 137 includes a braking screw 150 (see FIG. 11) that is operably connected to a brake pad 151 which extends at least partially into and through the inner wall 143 of the intermediate cylindrical section 123 of the second hinge component 102 via an aperture 152. The braking screw 150 and pad 151 align with a recessed section 136 of the distal end 135 of the lower cap member 130. As the hinge 100 moves from an unretained position toward the retained position, the brake pad 151 frictionally contacts the outer wall 153 of the distal end 135 of the lower cap member 130. As the hinge 100 approaches the retained position, the brake pad 151 applies less or no frictional force to the distal end 135 of the lower cap member 130 due to the recessed section 136 aligning with the brake pad 151. As shown in FIG. 11, the braking screw 150 and pad 151 can be mounted within an aperture 152 located in a protrusion 154 of the outer wall 155 of the intermediate cylindrical section 123, wherein the aperture 152 extends through to the inner wall 143 of the intermediate cylindrical section 123 and into the hollow 156. The aperture 152 has a threaded internal wall to allow the braking screw 150 to be engaged within the aperture 152 as well as to allow adjustment of the distance which the brake pad 151 extends within the hollow 156 of the intermediate cylindrical section 126, thereby customising the brake force applied. As can be seen in FIG. 3, the first arm 109 of the first hinge component 101 includes a cut-out section 157 which has a shape slightly bigger than the protrusion 154 to allow for the protrusion 154 to at least partially extend into the cut-out section 157 such that the first arms 109, 118 are placed in a face-to-face relationship in the retained position.

As will be appreciated from FIGS. 7 to 10, the position of the braking screw 150 is such that it can only be adjusted when the hinge 100 is in a position other than the retained position. This thereby prevents the braking screw 150 being adjusted whilst aligned with the recessed section 136 of the lower cap member 130 and thereby preventing over-tightening of the braking mechanism 137.

The main hinge components 101, 102, 121, 113, 129, 130 are well suited to being manufactured from a cheap material such as polyethylene or other plastic, however may also be made from any other suitable material. In one particular form, the first and second hinge components 101, the upper and lower cap members 129, 130 and the covers 121 are manufactured from moulded glass reinforced nylon.

It will be appreciated that the first and second securing portion 108, 117 could have a substantially curved cross-sectional profile along the pivot axis 103 in order to be secured to a curved structure, such as a pole having a circular cross-section.

In certain embodiments, the bottom spring tail 140 of the spring may engage within a hole of an internal walled section of the intermediary cylindrical section 123.

Figure 23:
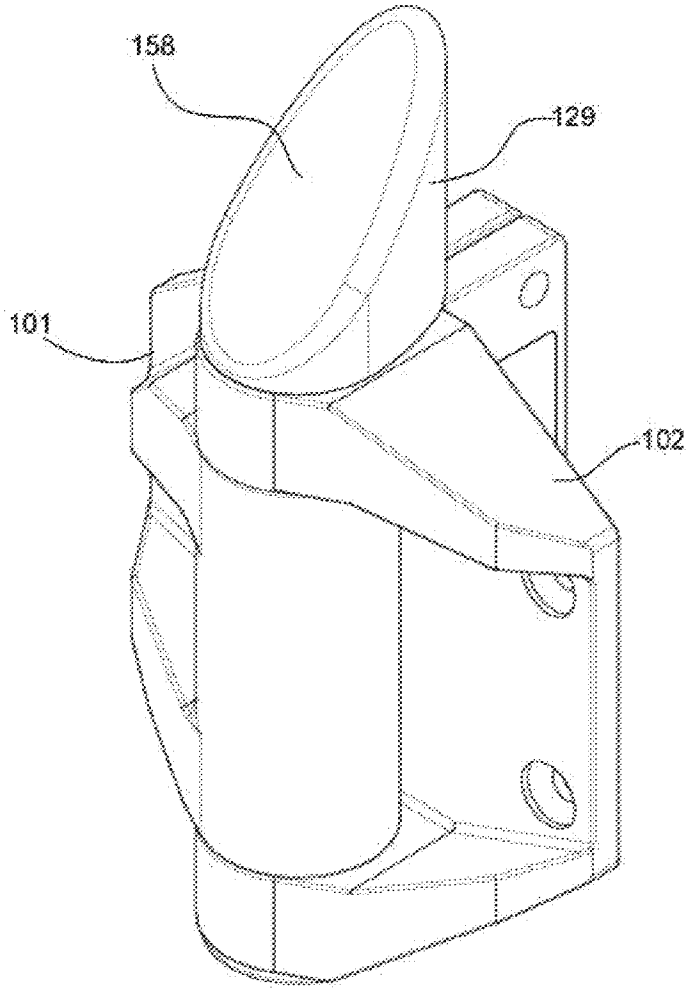
FIG. 23 is an isometric view of another example of a hinge including an alternate upper cap member
Figure 24:
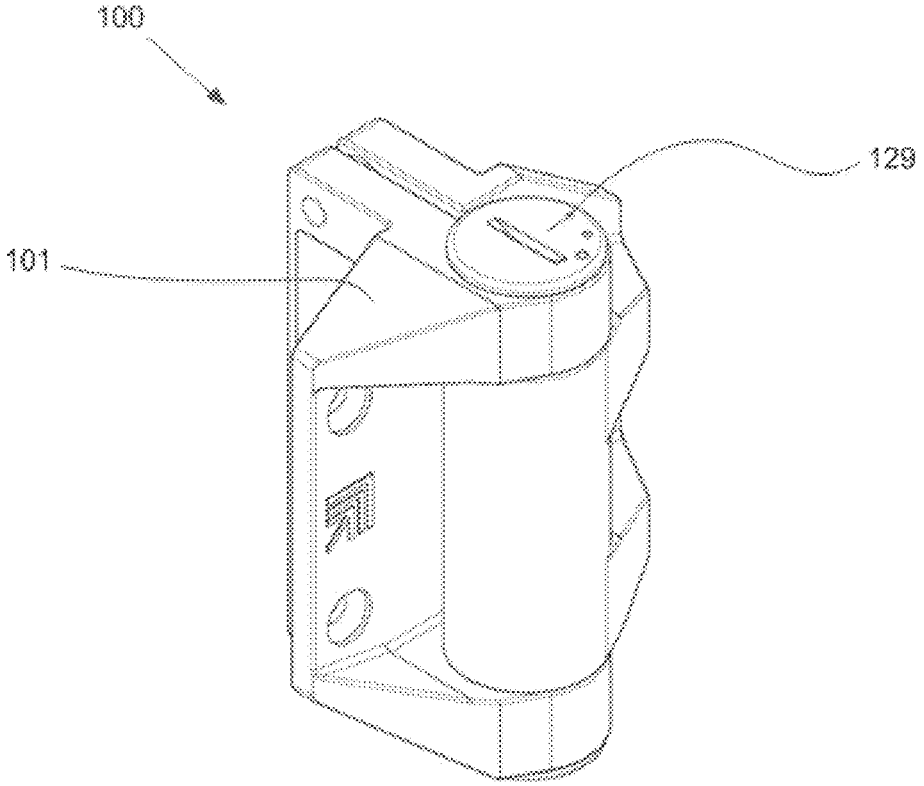
FIG. 24 is a first elevated front isometric view of another example hinge in the closed position.
Figure 25:
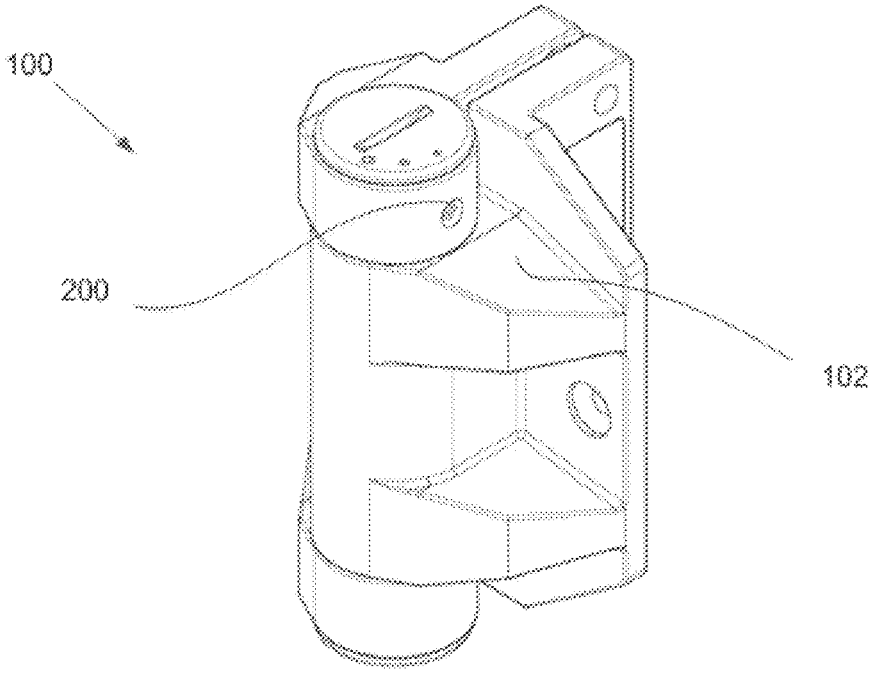
FIG. 25 is a second elevated front isometric view of the hinge of FIG. 24 in the closed position.
Figure 26:
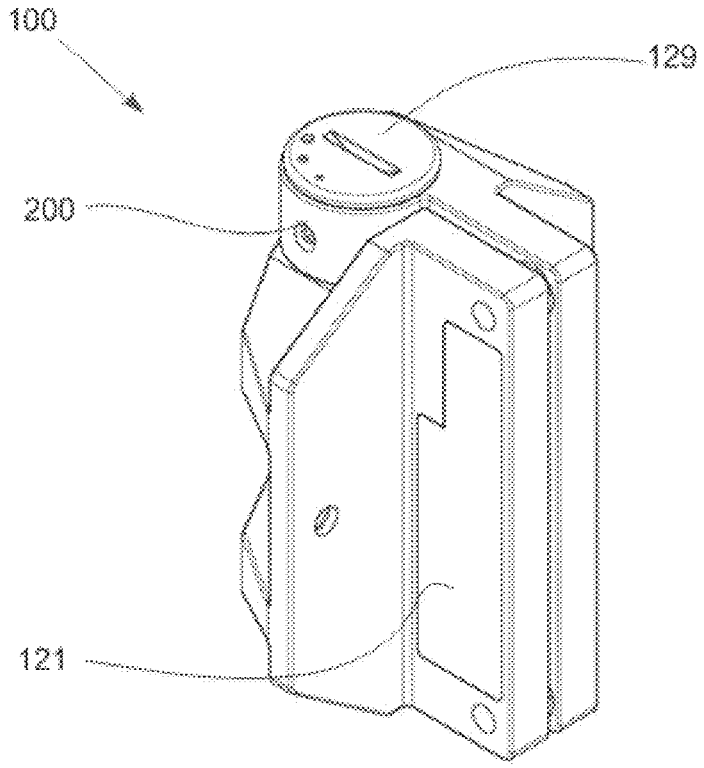
FIG. 26 is a first elevated rear isometric view of the hinge of FIG. 24 in the closed position.
Figure 27:
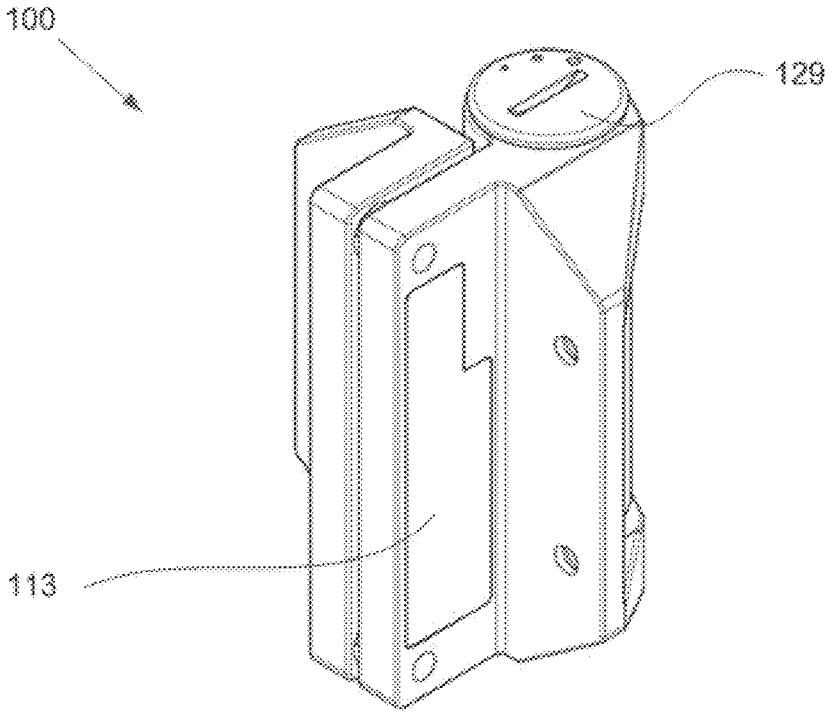
FIG. 27 is a second elevated rear isometric view of the hinge of FIG. 24 in the closed position.

Referring to FIG. 23, the upper cap member 129 can include a head which includes a sloped surface 158 to restrict children using the hinge 100 as a step.

Figure 31:
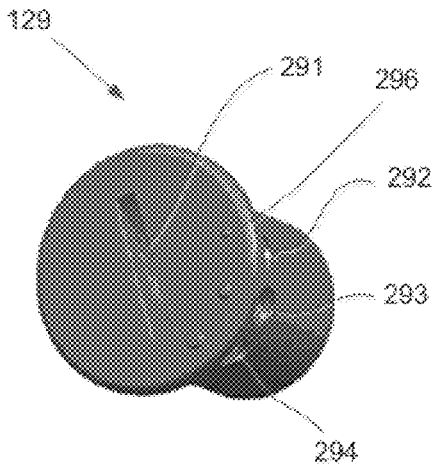
FIG. 31 is an elevated isometric view of the upper cap member of the hinge of FIG. 24.
Figure 32:
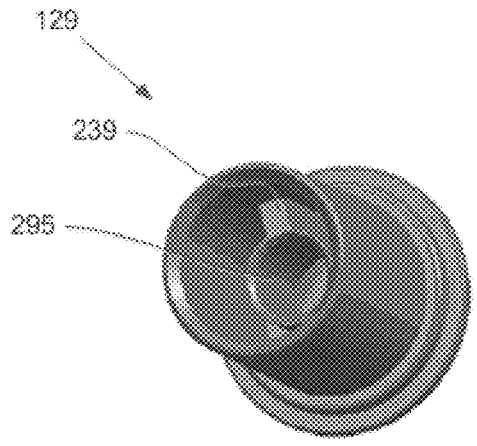
FIG. 32 is underside isometric view of the upper cap member of the hinge of FIG. 24.

Referring to FIGS. 24 to 30 there is shown a further embodiment of the hinge 100. The hinge 100 of this embodiment includes a spring tensioning mechanism to tighten the spring should the supplemental force of the attractive magnetic force between the magnetic elements 105, 107 be insufficient to move the hinge to the closed position. In particular, the spring tensioning mechanism includes the upper cap member 129, as shown in FIG. 31 which includes a series of indents 292, 293, 294 for receiving an end of a grub screw 200 through a hole 201 in the wall of the upper cylinder portion 114 of the first hinge component. When initially installed, the grub screw 200 may be in contact with the first indent 292. In the event that the spring 138 has lost tension, the grub screw 200 can be unscrewed to disengage the first indent 292, wherein the user uses a coin or screwdriver to turn the upper cap member 129 to tension the spring 138 due to the first spring tail 139 engaged against and resting on the inner wall 239. The upper cap member 129 can be turned such that the hole 201 in the upper cylinder member 114 aligns with one of the other indents 293, 294. Once aligned, the grub screw 200 can be retightened such that it engages one of the other indents 293, 294. More than three indents can be provided. The top of the end cap 129 additionally includes markings 296 to indicate the location of the indents 292, 293, 294 as well as the amount of mechanical bias which the spring 138 can apply to the hinge.

Alternatively, it will be appreciated that either the upper or lower bottom end cap member 129, 130 can be modified to include a spring tensioning mechanism as disclosed in Australian Patent No. 666491, the contents of which in herein incorporated by reference.

Figure 28:
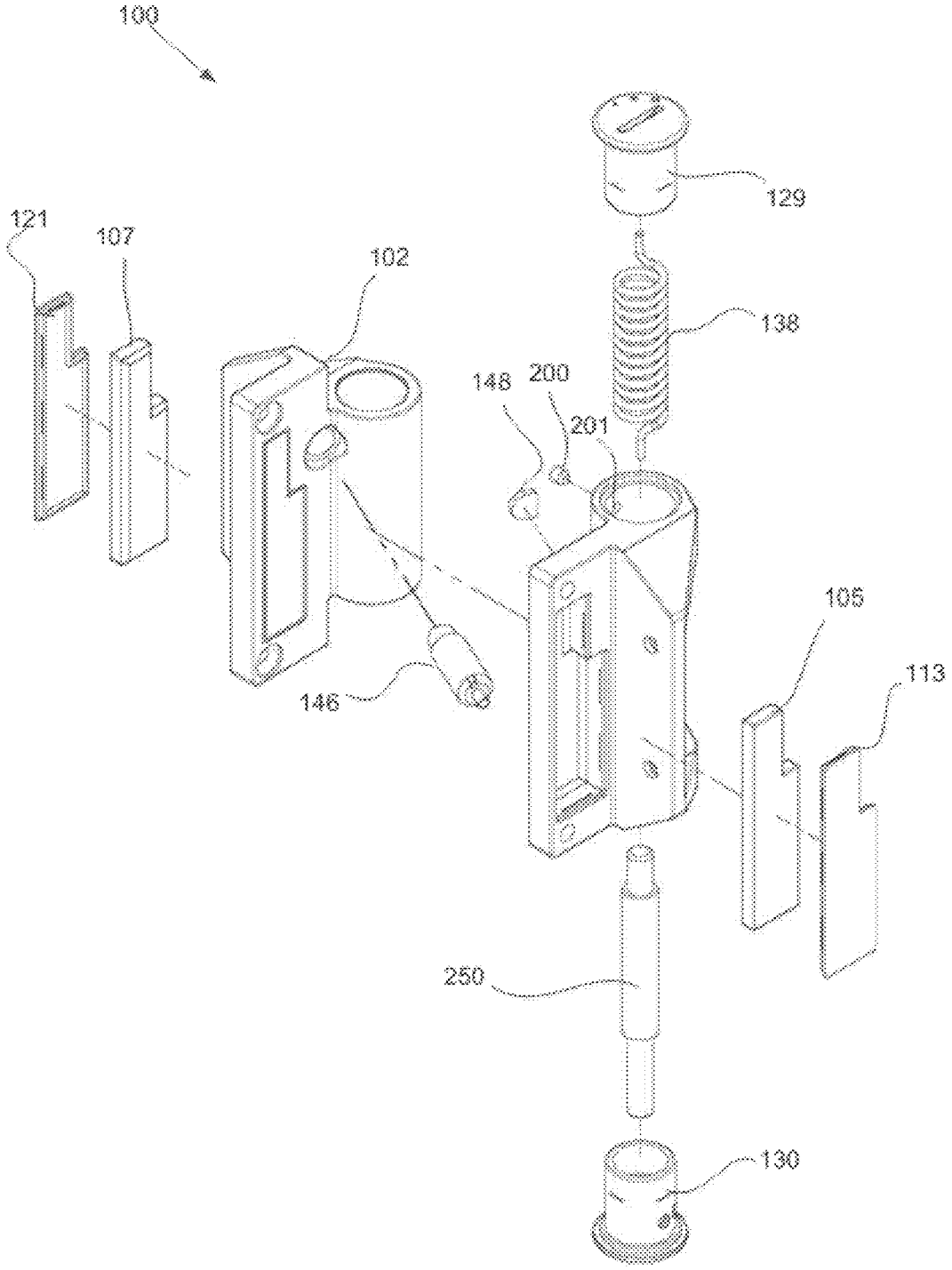
FIG. 28 is an exploded isometric view of the hinge of FIG. 24.
Figure 29:
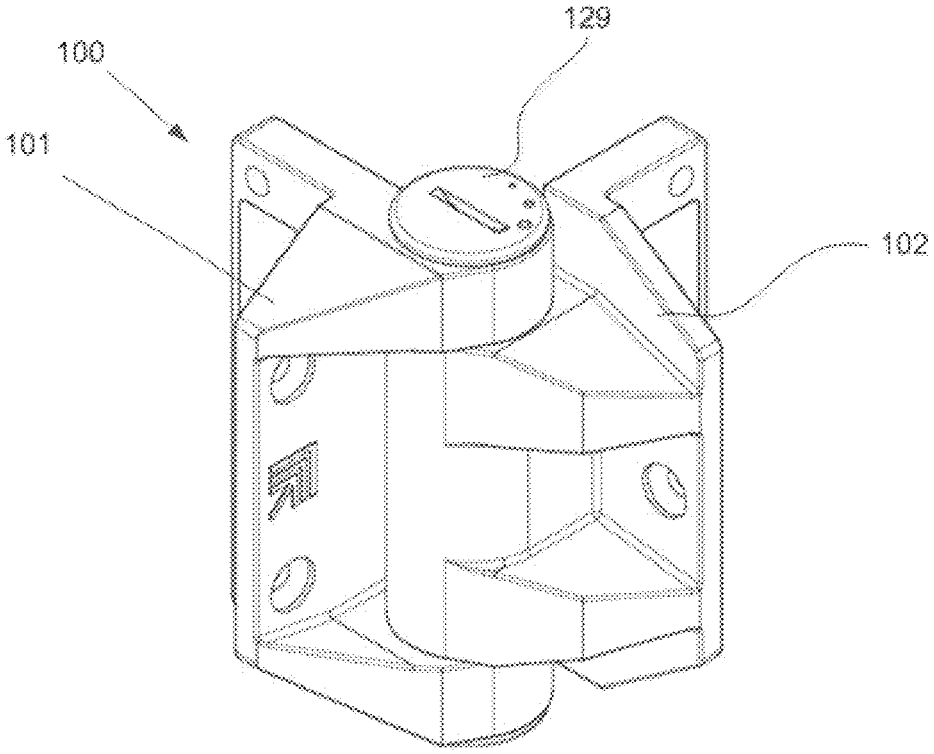
FIG. 29 is an elevated front view of the hinge of FIG. 24 in the open position.
Figure 30:
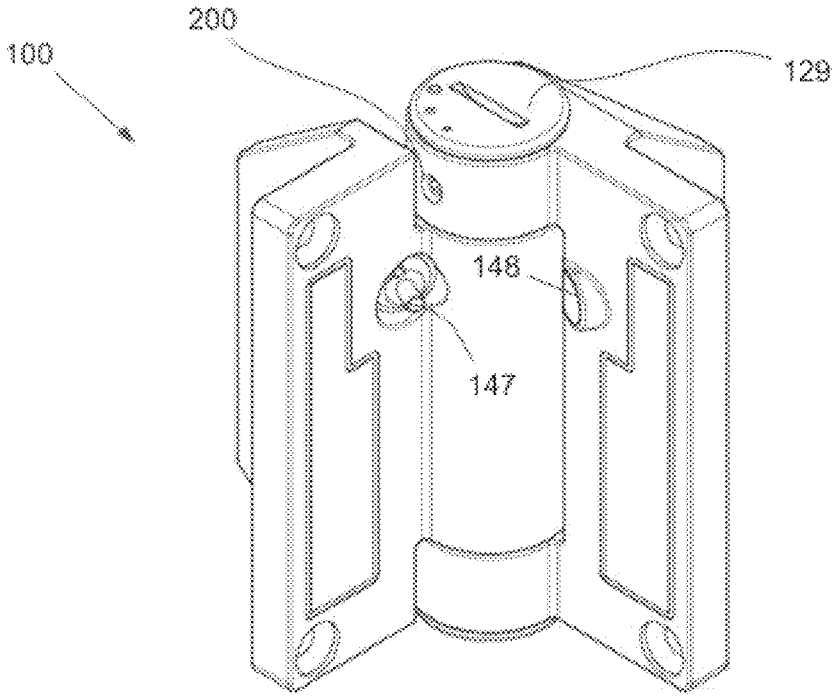
FIG. 30 is an elevated rear view of the hinge of FIG. 24 in the open position.

As shown in FIG. 28, the hinge 100 can include a spring stiffener 250 which is provided in the form of a rod. The spring stiffener 250 may extend between the upper and lower cap members 129, 130 to provide stability for the spring 138 within the intermediate cylindrical section 123. The spring stiffener 250 discourages the spring 138 from deflecting within the intermediate cylindrical section 123. The ends of the stiffener can be tight fittingly received by cap cavities 295 located in the upper and lower cap members 129, 130.

Figure 33:
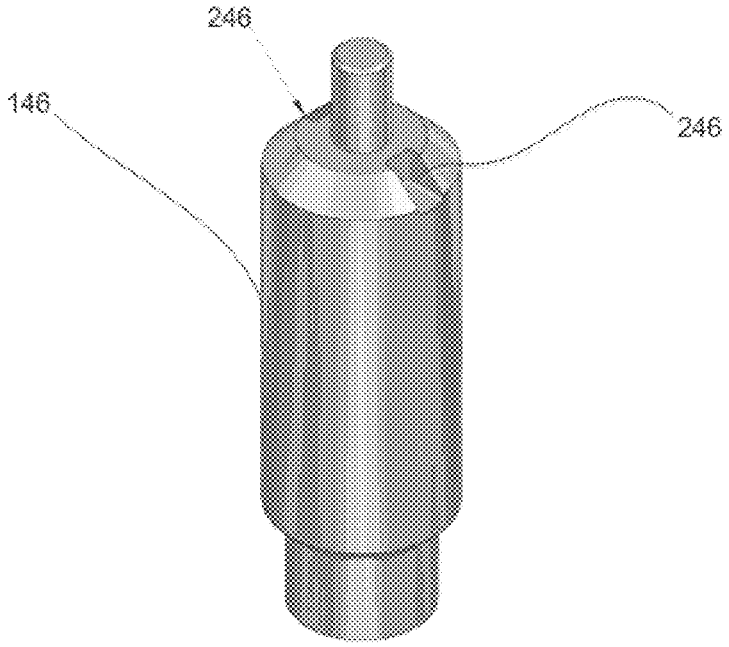
FIG. 33 is an elevated view of a dampener of the hinge of FIG. 24.

Referring to FIGS. 28 and 33, the dampener 146 can include diametrically opposed channels 246 that run along the length of the body and also the top surface thereof. The channels 246 enable a pair of pointy nose pliers or the like to engage the dampener 146 and apply a rotational force to the dampener 146 whilst being screwed into the void 144.

Figure 34:
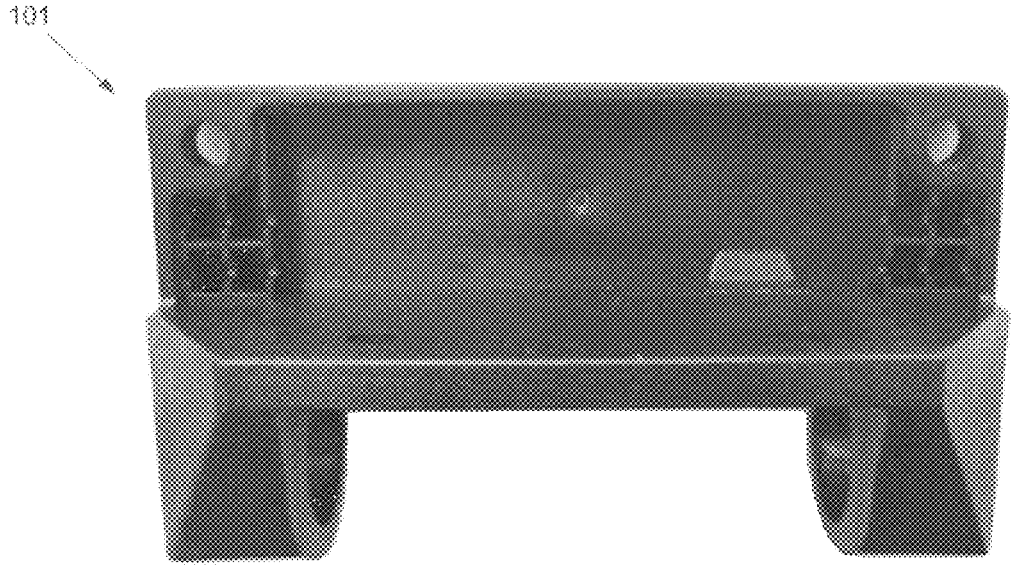
FIG. 34 is a perspective view of an alternate first hinge component.
Figure 35:
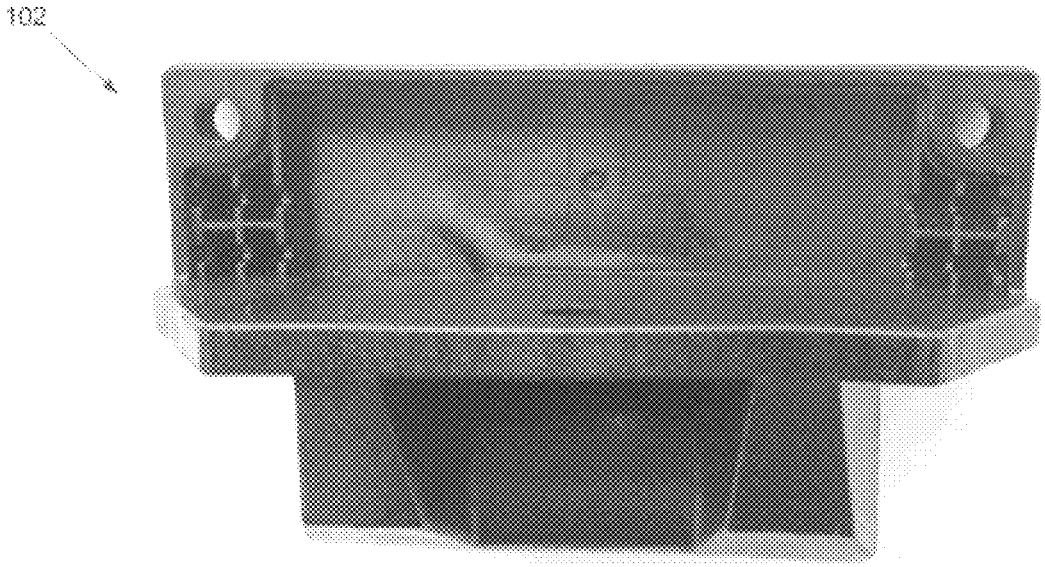
FIG. 35 is a perspective view of an alternative second hinge component.
Figure 39:
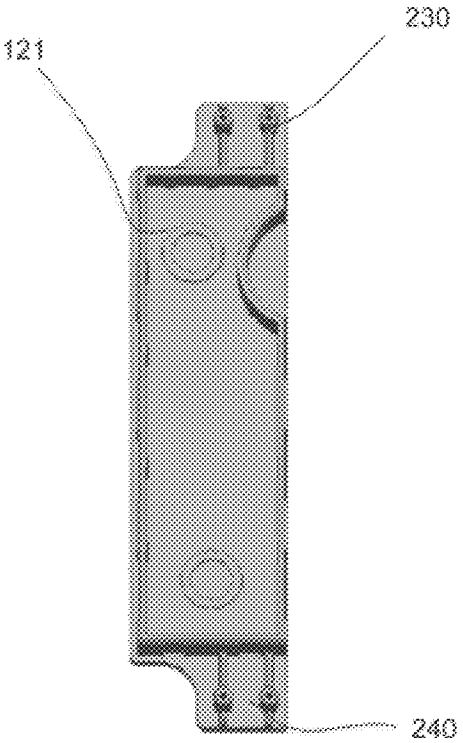
FIG. 39 is an underside view of the second cover element of FIG. 38.
Figure 38:
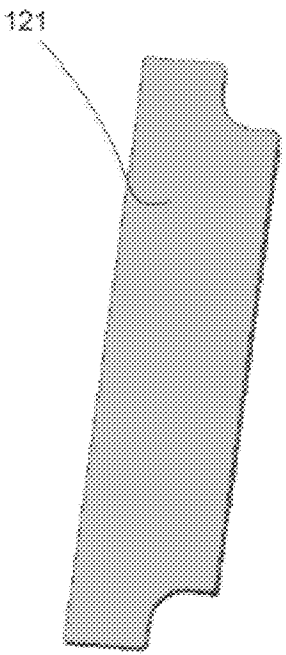
FIG. 38 is a top view of the second cover element for the second hinge component of FIG. 35.
Figure 37:
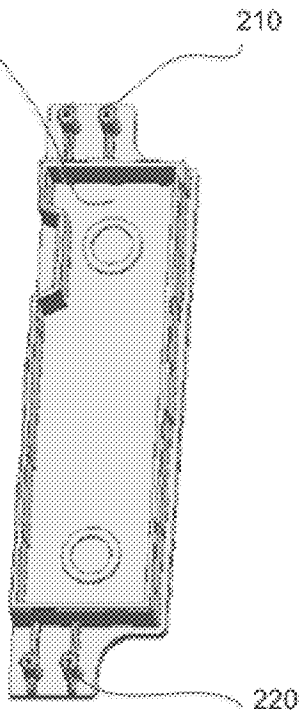
FIG. 37 is a rotated underside view of the first cover element of FIG. 36.
Figure 36:
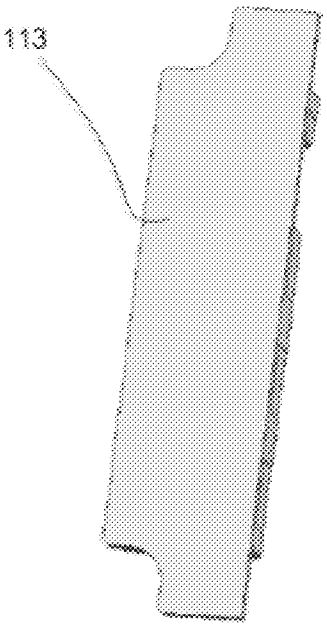
FIG. 36 is a top view of the first cover element for the first hinge component of FIG. 34.

As shown in FIG. 28, the magnetic elements 105, 107 can have a non-rectangular profile such that the magnetic elements 105, 107 can substantially extend the length of the arms 109, 118. However, referring to FIGS. 34 and 35 there is shown a further embodiment of a hinge, where rectangular magnetic elements 105, 107 can be received within the respective cavities. As shown in FIGS. 36 to 39, the cover elements 113, 121 can include pins 210, 220, 230, 240 which are received within pin receiving areas of the cavity 112, 120 to align the covers and to provide a snap-fit arrangement.

Optional embodiments of the present invention may also be said to broadly consist in the parts, elements and features referred to or indicated herein, individually or collectively, in any or all combinations of two or more of the parts, elements or features, and wherein specific integers are mentioned herein which have known equivalents in the art to which the invention relates, such known equivalents are deemed to be incorporated herein as if individually set forth.

Although a preferred embodiment has been described in detail, it should be understood that various changes, substitutions, and alterations can be made by one of ordinary skill in the art without departing from the scope of the present invention.

What is claimed is:

1. A hinge including:

a first hinge leaf assembly including:

a first hinge component having:

a first mounting surface for securing to a first structure; and a plurality of first knuckles; and a second hinge leaf assembly, pivotally coupled to the first hinge leaf assembly, including:

a second hinge component having:

a second mounting surface for securing to a second structure; and a second knuckle;

a spring operatively connected to the first and second hinge leaf assemblies to bias the first hinge assembly and the second hinge assembly toward a closed position, wherein the spring is located with a hollow defined by coaxial alignment of the plurality of first knuckles and the second knuckle;

a spring tensioning mechanism to adjust the bias of the spring; and a dampener configured to slow the movement of the first hinge assembly relative to the second hinge assembly when moving toward the closed position, wherein the dampener is a hydraulic dampener.

2. The hinge according to claim 1, wherein the spring tensioning mechanism includes:

a cap including:

a skirt which is receivable through one of the first knuckles, wherein the skirt includes a plurality of indents; and an aperture to receive a tail of the spring; and a screw receivable through a hole in a wall of the hollow for engaging with one of the plurality of indents which aligns with the hole such that the cap is non-rotatable relative to the receiving first knuckle, wherein the screw is able to disengage the respective engaged indent to allow the cap to be rotated relative to the first knuckle such that the tension of the spring is adjustable prior to re-engagement of the screw with a different one of the plurality of indents.

3. The hinge according to claim 2, wherein the cap includes a groove in a cap surface to enable a tool to be engaged within the groove to allow the cap to be rotated relative to the first knuckle.

4. The hinge according to claim 2, wherein the plurality of first knuckles includes an upper ring section and a lower ring section, and the second knuckle is an intermediate hollow cylindrical section which is located between and coaxial with the upper and lower ring sections.

5. The hinge according to claim 4, wherein a portion of the skirt of the cap protrudes into the intermediate hollow cylindrical section.

6. The hinge according to claim 1, wherein a body of the dampener is housed within a dampener cavity provided by one of the first and second hinge components, wherein a movable portion of the dampening mechanism protrudes outwardly from the dampener cavity and retracts within the body when the hinge moves toward the retained position.

7. The hinge according to claim 6, wherein the dampener includes a screw thread located at a base portion of the body for securing the dampener within the dampener cavity which includes a complementary screw thread, wherein an end portion of the body includes diametrically opposed gripping apertures to enable a tool to grip and rotate the dampener for securing within the dampener cavity.

8. The hinge according to claim 7, wherein the dampener includes diametrically opposed channels that extend from the diametrically opposed gripping cavities longitudinally along the body of the dampener.

9. The hinge according to claim 1, wherein the dampener is housed within a cavity of the first hinge component, wherein the first hinge component includes a pair of arms which define the second mounting surface, wherein the pair of arms extend from the second knuckle, wherein the cavity is located at a junction between one of the arms of the pair of arms and the second knuckle.

10. The hinge according to claim 1, wherein the first hinge component includes a first pair of arms that define the first mounting surface, the first pair of arms extend from the first knuckles, and the second hinge component includes a second pair of arms that define the second mounting surface, the second pair of arms extend from the second knuckle.

11. The hinge according to claim 10, wherein one of the arms of the first pair of arms includes a first arm cavity which is releasably closed with a first lid, wherein an external surface of the first lid is a portion of the first mounting surface, and wherein one of the arms of the second pair of arms includes a second arm cavity which is releasably closed with a second lid, wherein an external surface of the second lid is a portion of the second mounting surface.

12. The hinge according to claim 11, wherein the hinge includes a first magnetic element located within the first arm cavity and a second magnetic element located within the second arm cavity, wherein a magnetic attractive force between the first and second magnetic elements contribute to biasing the first hinge component and the second hinge component toward the closed position.

13. The hinge according to claim 10, wherein the first hinge component includes a first pair of ridges, each first ridge extending from a respective one of the first knuckles and tapers toward a distal side edge of the one of the arms of the first pair of arms, and wherein the second hinge component includes a second pair of ridges, each second ridge extending from the second knuckle and tapers toward a distal side edge of the one of the arms of the second pair of arms.

14. The hinge according to claim 10, wherein each arm of the first pair of arms includes holes for mounting the first structure to the first hinge component, and wherein each arm of the second pair of arms includes holes for mounting the second structure to the second hinge component.

15. The hinge according to claim 1, wherein one of the first and second hinge leaf assemblies includes the dampener, and the other one of the first and second hinge leaf assemblies includes a striker component, wherein the movable portion of the dampener is configured to strike the striker component when moving toward the closed position.

16. The hinge according to claim 15, wherein a portion of the striker angularly projects beyond a planar face of the second mounting surface.

17. The hinge according to claim 16 wherein the portion of the striker which angularly projects beyond the planar face of the second mounting surface projects within the dampener cavity in the closed position.

18. The hinge according to claim 1, wherein the hinge includes:

a first cap which caps a top first knuckle of the plurality of first knuckles, wherein the first cap includes a first stiffener cavity;

a second cap which caps a bottom first knuckle of the plurality of the first knuckles, wherein the first cap includes a second stiffener cavity; and a stiffener rod having a first end received within the first stiffener cavity and a second end received within the second stiffener cavity, wherein the stiffener rod extends longitudinally through the spring.

19. A hinge including:

a first hinge leaf assembly including:

a first hinge component having:

a first mounting surface for securing to a first structure; and a plurality of first knuckles; and a second hinge leaf assembly, pivotally coupled to the first hinge leaf assembly, including:

a second hinge component having:

a second mounting surface for securing to a second structure; and a second knuckle;

a spring operatively connected to the first and second hinge leaf assemblies to bias the first hinge component and the second hinge component toward a closed position, wherein the spring is located with a hollow defined by coaxial alignment of the plurality of first knuckles and the second knuckle;

a spring tensioning mechanism to adjust the bias of the spring; and a dampener configured to slow the movement of the first hinge assembly relative to the second hinge assembly when moving toward the closed position;

wherein one of the first and second hinge leaf assemblies includes the dampener, and the other one of the first and second hinge leaf assemblies includes a striker component, wherein the movable portion of the dampener is configured to strike the striker component when moving toward the closed position.

20. A hinge including:

a first hinge leaf assembly including:

a first hinge component having:

a first mounting surface for securing to a first structure; and a plurality of first knuckles; and a second hinge leaf assembly, pivotally coupled to the first hinge leaf assembly, including:

a second hinge component having:

a second mounting surface for securing to a second structure; and a second knuckle;

a spring operatively connected to the first and second hinge leaf assemblies to bias the first hinge component and the second hinge component toward a closed position, wherein the spring is located with a hollow defined by coaxial alignment of the plurality of first knuckles and the second knuckle; and a spring tensioning mechanism to adjust the bias of the spring, wherein the spring tensioning mechanism includes:

a cap including:

a skirt which is receivable through one of the first knuckles, wherein the skirt includes a plurality of indents; and an aperture to receive a tail of the spring; and a screw receivable through a hole in a wall of the hollow for engaging with one of the plurality of indents which aligns with the hole such that the cap is non-rotatable relative to the receiving first knuckle, wherein the screw is able to disengage the respective engaged indent to allow the cap to be rotated relative to the first knuckle such that the tension of the spring is adjustable prior to re-engagement of the screw with a different one of the plurality of indents.

* * * * *